US007616222B2

(12) United States Patent
Chuang et al.

(10) Patent No.: US 7,616,222 B2
(45) Date of Patent: Nov. 10, 2009

(54) DRIVE METHOD TO REDUCE POWER DISSIPATION FOR FLAT PANEL DISPLAY

(75) Inventors: Yu-Chun Chuang, Hsinchu (TW); Wan-I Shih, Hsinchu (TW)

(73) Assignee: Silicon Touch Technology Inc., Hsinchu (TW)

( * ) Notice: Subject to any disclaimer, the term of this patent is extended or adjusted under 35 U.S.C. 154(b) by 663 days.

(21) Appl. No.: 11/285,041

(22) Filed: Nov. 23, 2005

(65) Prior Publication Data

US 2006/0238552 A1 Oct. 26, 2006

(30) Foreign Application Priority Data

Apr. 22, 2005 (TW) ..... 94112840 A

(51) Int. Cl.
*G09G 5/10* (2006.01)
*G09G 5/00* (2006.01)

(52) U.S. Cl. ..... 345/690; 345/211

(58) Field of Classification Search ..... 345/690
See application file for complete search history.

(56) References Cited

U.S. PATENT DOCUMENTS 4,323,896 A * 4/1982 Fiedler et al. ..... 345/691
5,444,457 A * 8/1995 Hotto ..... 345/94
7,239,297 B2 * 7/2007 Tajima et al. ..... 345/89
2004/0257389 A1 * 12/2004 Saito et al. ..... 345/690

* cited by examiner

*Primary Examiner*—Richard Hjerpe
*Assistant Examiner*—Dorothy Webb
(74) *Attorney, Agent, or Firm*—Rosenberg, Klein & Lee

(57) ABSTRACT

A control module for reducing power dissipation is connected to a column driving unit and a row driving unit. The control module includes a memory for storing display data temporarily and an arithmetic/logic unit connected to the memory. The arithmetic/logic unit takes grayscale image data of a current conducted row as a base row to compare with the grayscale image data of n rows that are temporarily stored in the memory and waiting to be scanned, so as to select the row with a minimum gray level difference as a next conducted row.

1 Claim, 2 Drawing Sheets

DRIVE METHOD TO REDUCE POWER DISSIPATION FOR FLAT PANEL DISPLAY

BACKGROUND OF THE INVENTION

1. Field of the Invention

The invention relates in general to a scan method for a flat panel display drive device, and more particularly to a scan method that determines a scanning sequence according to a gray level difference of image data to reduce power dissipation.

2. Description of the Related Art

Referring to FIG. 2, a driving circuit for a conventional flat panel display is shown. A column driving unit 62 and a row driving unit 64 work together to control a flat panel 50 in general. The column driving unit 62 and the row driving unit 64 connects to a plurality of data lines 63 and scan lines 65, respectively. Multiple pixels 51 are formed on the flat panel 50. Each pixel 51 is mapping to a cross-position formed by the data lines 63 and the scan lines 65.

When controlling the flat panel 50 to output an image, the row driving unit 64 sequentially outputs scan signals to the scan lines 65. Each pixel 51 on the same row is determined to be charged or discharged according to a grayscale signal outputted by its own data line 63. A scan update speed is very prompt; hence static image quality of the output image can be displayed on the flat panel 50 due to 'retention of image' phenomenon experienced in human vision.

Consumer demand for increasingly higher resolution flat panel displays has resulted in the quantity of pixels on flat panels accordingly rising. Hence less time is distributed to conduct each scan line 65 while an update frequency on the image is unchanging. Therefore it is difficult for each pixel 51 to be fully charged/discharged within a very short time, thereby impairing the image quality and greatly decreasing a contrast degree on the image.

Moreover, a power dissipation problem is also a critical issue of the flat panel 50. The conventional row driving unit 64 as foresaid outputs the scan signals to the scan line 65 from the top to the bottom in sequence. Hence the power dissipation problem is manifest due to extremely charged/discharged operations when a huge grayscale variation exists between the pixels 51 of the two adjacent scan lines 65.

The flat panel is applied in various compact and portable electronic devices such as cell phones, PDAs, digital MP3 players, and so on. If the power dissipation of the flat panel can be effectively reduced, the entire power consumption of the electronic device can be accordingly improved.

SUMMARY OF THE INVENTION

In view of the drawback of the conventional drive method for the flat panel device that higher power dissipation is generated due to a huge grayscale signal variation, it is accordingly an object of the present invention to provide a scan method that determines a scanning sequence according to a grayscale difference of image data to reduce power dissipation.

To achieve the above-mentioned objective, the present invention makes use of a drive device to control a panel that is formed with a plurality of pixels. The drive device mainly includes a column driving unit, a row driving unit, and a control module.

The column driving unit outputs a plurality of data lines to the panel. The row driving unit outputs a plurality of scan lines to the panel. The scan lines and the data lines contribute together to control the pixels on the panel. The control module is connected to the column driving unit and the row driving unit. The control module includes a memory for storing display data temporarily and an arithmetic/logic unit connected to the memory. The arithmetic/logic unit takes grayscale image data of a current conducted row as a base row to compare with the grayscale image data of n rows that are temporarily stored in the memory and waiting to be scanned, so as to select the row with a minimum gray level difference as a next conducted row.

The grayscale image data of the base row is compared with the grayscale image data of other rows which wait to be displayed one by one to calculate the gray level difference, and to select the row with the minimum gray level difference as the next conducted row until all of the m rows of the scan lines finish a complete scan update cycle.

Therefore, the power dissipation can be efficiently reduced with the method to compare the gray level difference of the image data to find an optimal scanning sequence.

DETAILED DESCRIPTION OF THE INVENTION

Figure 1:
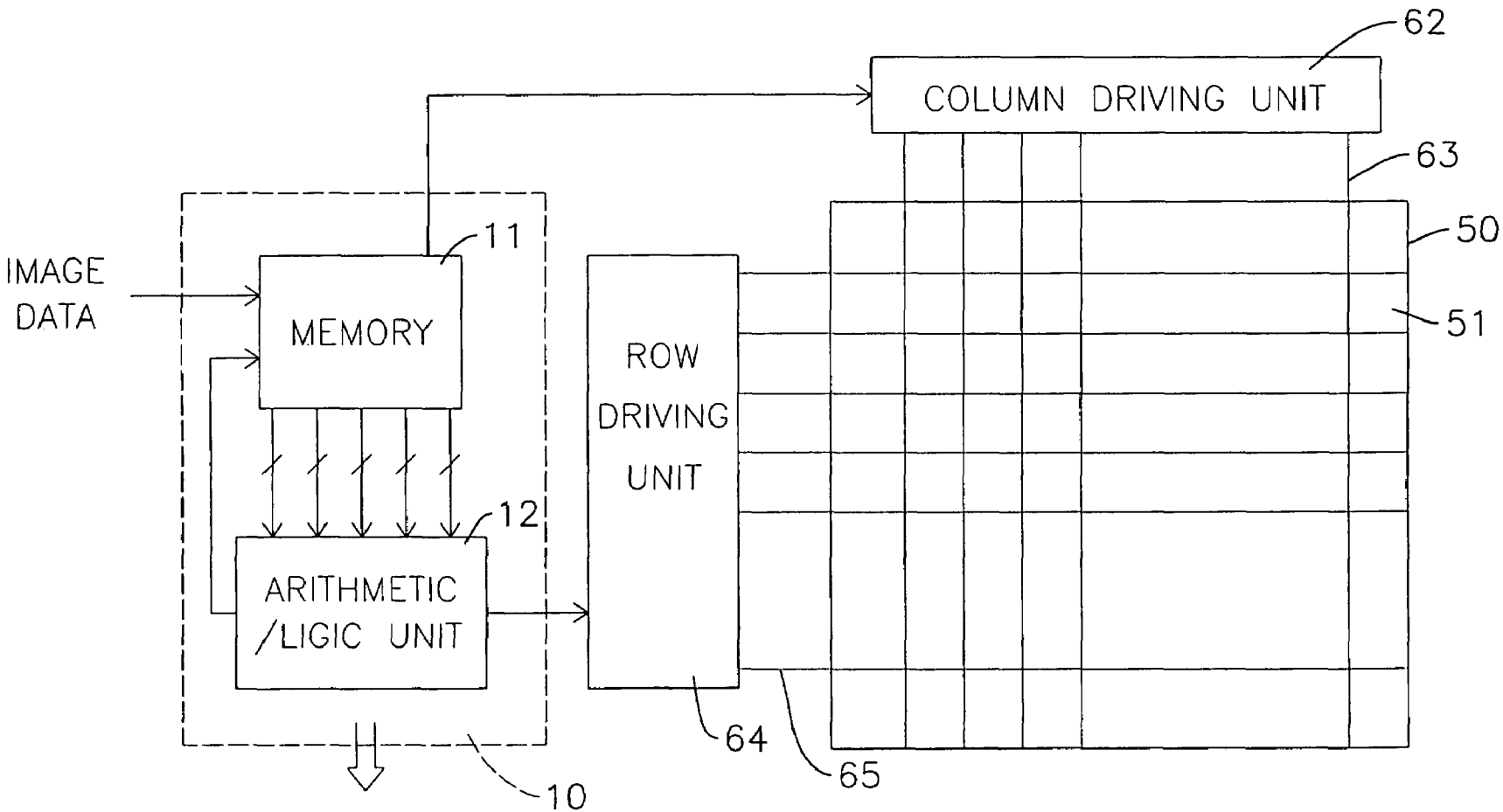
FIG. 1 shows a circuit block diagram of the present invention.
Figure 2:
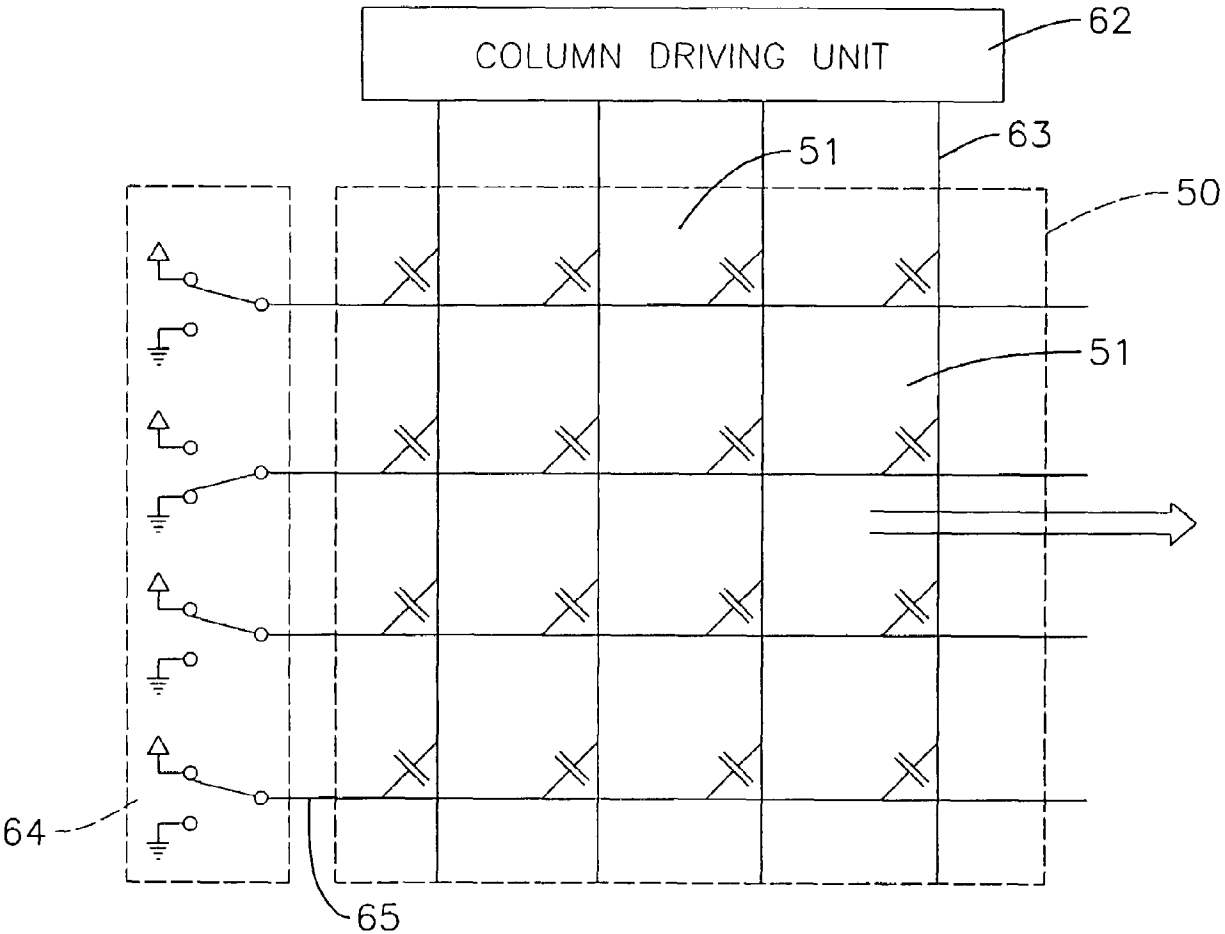
FIG. 2 PRIOR ART
FIG. 2 shows a diagram of a conventional drive method of a flat panel display.

Referring to FIG. 1, a circuit block diagram of the present invention is shown. A flat panel 50 is controlled by a column driving unit 62 and a row driving unit 64 as aforesaid prior art. A plurality of scan lines 65 output by the row driving unit 64 and a plurality of data lines 63 output by the column driving unit 62 contribute together to control a plurality of pixels 51 arranged in a matrix on the panel. Moreover, a control module 10 determines a scanning sequence. The control module 10 includes a memory 11 for storing display data temporarily and an arithmetic/logic unit 12 connected to the memory 11.

According to the aforesaid prior art technique, the higher power dissipation is generated due to the huge grayscale variation of the two adjacent rows. Hence, if the grayscale variation between the two conducted rows can be diminished, the power dissipation can be effectively reduced. In terms of the above objective, a method of the present invention is provided as follows.

First of all, image data that waits to be displayed is stored temporarily in the memory 11. Then the temporarily stored image data is read from the memory 11 and outputted to the arithmetic/logic unit 12. A grayscale value of the scanning image data of a row is compared with other grayscale values of the image data that is waiting to be scanned one by one to compute a gray level difference between two rows. The row with the minimum gray level difference of the image data is selected as the next scanning row. The above step is repeated until all rows of the image data are all displayed.

To specifically explain the above method, several examples of the preferred embodiments of the present invention are provided as follows.

Firstly, $$GLD_{(ij)} = \sum_{k=1}^{n} |D_{ik} - D_{jk}|$$

represents the gray level difference between two different rows of $Row_i$ and $Row_j$ where D represents the gray level value of each pixel point which is expressed by m bits ($2^m$) in general. Supposing that there are n pixels in one row, the gray level difference values of the two different rows (i,j) for a corresponding pixel point respectively is $|D_{ik}-D_{jk}|$. Thus a sum of the gray level difference values of the pixel points represents the $GLD_{(ij)}$ of the two different rows $Row_i$ and $Row_j$. To simplify the calculation, although the m bits ($2^m$) express the gray level of each pixel point, the most significant bit (MSB) having more obvious gray level value is taken for the calculation and the less significant bit (LSB) is neglected in an actual computation. For example, while computing $a_5 a_4 a_3 a_2 a_1 a_0$-$b_5 b_4 b_3 b_2 b_1 b_0$, $a_1 a_0$ and $b_1 b_0$ bits can be neglected and only the front four bits $a_5 a_4 a_3 a_2$ and $b_5 b_4 b_3 b_2$ are taken for comparison.

EXAMPLE METHOD A

Assume that the first row is the current conducted row. The $GLD_{(21)}$, $GLD_{(31)}$, . . . $GLD_{(s1)}$ for the gray level difference between the first row and the second row until the sth row are computed respectively by using the arithmetic/logic unit 12, so as to select the minimum gray level difference value. If the $GLD_{(31)}$ is minimum, the third row is thus selected as the next conducted row. Then the second, the fourth until the sth rows are compared with the third row to get the values of $GLD_{(23)}$, $GLD_{(43)}$, . . . $GLD_{(s3)}$ to select the minimum gray level difference value again. In this way, the next conducted row is determined again. Hence this method is achieved by repeating the above step until all rows of the scan lines finish a complete scan update cycle.

EXAMPLE METHOD B

This method is to make the arithmetic/logic unit 12 compare the image data of the current conducted row with the image data of the rest N rows (at least two rows). The next conducted row is then determined by selecting the minimum gray level difference. Those unselected image data are still temporarily stored in the memory 11.

Base on the selected conducted row to compare with the image data temporary stored in the memory 11, the next conducted row having the minimum gray level difference value is then determined. Hence this method is achieved by repeating the above step until all rows of the scan lines finish a complete scan update cycle.

Take two rows as an example (N=2). If the current conducted row is the first row, the second and the third rows are compared with the first row respectively to get $GLD_{(21)}$ and $GLD_{(31)}$. If $GLD_{(31)}<GLD_{(21)}$, the third row is selected as the next conducted row. Simultaneously, the data image of the second row is still temporarily stored in the memory 1. Then the image data of the fourth row is fetched and read to calculate the gray level difference value of $GLD_{(23)}$ and $GLD_{(43)}$ and so forth.

However, in the above-described two methods A and B, special case will take place when the gray level difference is too large between the conducted row and the specific ones, which results in the scanning speed of such row become extremely low. If the scanning speed is lower than the sufficient frame rate, human eyes are likely detecting the flicker of the frame. In order to avoid the aforesaid situation that impairs the image display quality, the control module 10 includes a function to force such scan lines to be scanned and updated in a specific time. Even though the gray level difference value of the particular row does not meet a requirement, the particular row is still forced to be conducted to scan, so as to provide an optimum image output.

EXAMPLE METHOD C

This method is based on grouping a constant quantity of rows to get the most efficient sequence to conduct the data rows. For example, if four rows are grouped as $Row_1$, $Row_2$, $Row_3$, and $Row_4$ where the current conducted row is the $Row_1$, then the following values are computed:

$$SGLD_{(1\to2\to3\to4)}=GLD_{(21)}+GLD_{(32)}+GLD_{(43)}$$

$$SGLD_{(1\to2\to4\to3)}=GLD_{(21)}+GLD_{(42)}+GLD_{(34)}$$

$$SGLD_{(1\to3\to2\to4)}=GLD_{(31)}+GLD_{(23)}+GLD_{(42)}$$

$$SGLD_{(1\to3\to4\to2)}=GLD_{(31)}+GLD_{(43)}+GLD_{(24)}$$

$$SGLD_{(1\to4\to2\to3)}=GLD_{(41)}+GLD_{(24)}+GLD_{(32)}$$

$$SGLD_{(1\to4\to3\to2)}=GLD_{(41)}+GLD_{(34)}+GLD_{(23)}$$

The above six SGLD values indicate all possible permutations for the sum of the gray level difference values of the four rows. The minimum SGLD value represents the optimum sequence to conduct the scan lines. When the sequence for the $Row_1$ to $Row_4$ is determined, the most recent conducted row is set as the base row to compare with $Row_5$, $Row_6$, and $Row_7$. Thereby the optimum sequence for $Row_5$ to $Row_7$ can be determined. In this way, N rows of data are grouped to be computed until all rows on the panel are computed. This method can avoid the aforesaid situation that the particular row is unable to be conducted to scan in the above-described two methods A and B, thereby impairing the image display quality.

In view of the drawback of the conventional drive method having higher power dissipation due to the simple scanning sequence line by line, it is accordingly the object of the present invention to provide the scan method that determines the scanning sequence according to the gray level difference of the image data to reduce power dissipation. Therefore, the present invention greatly improves the conventional drive method.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A driving method for reducing power dissipation for a flat panel display, wherein the flat panel display comprises m rows of scan lines, the method comprising the steps of:

defining N rows of scan lines as a current group that comprises N−1 rows waiting to be scanned and one row as a base row scanned last in a previous group;

generating (N−1)! types of sequences, the N rows of scan lines arranged in accordance with a unique order in each sequence;

calculating N−1 gray level difference values for each sequence, each gray level difference value obtained by comparing two adjacent rows arranged in accordance with the unique order;

summing the multiple gray level difference values in each sequence to obtain a summation value of the sequence; and scanning the N−1 rows of the scan lines waiting to be scanned based on the unique order of the sequence corresponding to a minimum summation value.

* * * * *

UNITED STATES PATENT AND TRADEMARK OFFICE

CERTIFICATE OF CORRECTION

PATENT NO. : 7,616,222 B2
APPLICATION NO. : 11/285041
DATED : November 10, 2009
INVENTOR(S) : Chuang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1015 days.

Signed and Sealed this

Nineteenth Day of October, 2010

David J. Kappos

David J. Kappos
*Director of the United States Patent and Trademark Office*